US010213002B2

(12) United States Patent
Cho

(10) Patent No.: US 10,213,002 B2
(45) Date of Patent: Feb. 26, 2019

(54) CAPSULE-TYPE HEATER DEVICE

(71) Applicant: SPS CO., LTD, Cheonan-si, Chungcheongnam-do (KR)

(72) Inventor: Won Suk Cho, Anseong-si (KR)

(73) Assignee: SPS CO., LTD, Cheonan-si, Chungcheongnam-do (KR)

( * ) Notice: Subject to any disclaimer, the term of this patent is extended or adjusted under 35 U.S.C. 154(b) by 250 days.

(21) Appl. No.: 15/314,072

(22) PCT Filed: Sep. 24, 2015

(86) PCT No.: PCT/KR2015/010138
§ 371 (c)(1),
(2) Date: Nov. 26, 2016

(87) PCT Pub. No.: WO2016/052937
PCT Pub. Date: Apr. 7, 2016

(65) Prior Publication Data

US 2017/0188682 A1 Jul. 6, 2017

(30) Foreign Application Priority Data

Sep. 30, 2014 (KR) ..... 10-2014-0131530

(51) Int. Cl.
*H05B 1/00* (2006.01)
*H05B 3/00* (2006.01)
(Continued)

(52) U.S. Cl.
CPC ..... *A45D 20/12* (2013.01); *A45D 1/04* (2013.01); *A45D 20/10* (2013.01); *H05B 3/16* (2013.01); *A45D 2001/004* (2013.01)

(58) Field of Classification Search
CPC ..... A45D 20/44; A45D 20/04; A45D 20/08; A45D 20/10; A45D 1/04; A45D 2001/004; A45D 20/26; A45D 20/28; A45D 20/38; A45D 20/50; A45D 20/46; A45D 20/22; A45D 20/12; H05B 3/16; H05B 1/00; H05B 3/02; H05B 3/06; H05B 3/32; H05B 3/26; H05B 3/20; F24D 19/02; F24H 9/00
USPC ..... 219/225, 226–229, 261, 521, 552–553; 34/96–97; 132/212; 392/383–385, 392/409–410, 432–434
See application file for complete search history.

(56) References Cited

U.S. PATENT DOCUMENTS 8,146,264 B1 4/2012 Stefano et al.

FOREIGN PATENT DOCUMENTS

KR 20-0200751 Y1 10/2000
KR 20-2011-0006463 U 6/2011
(Continued)

OTHER PUBLICATIONS

Machine translation of KR 20110006463.*

*Primary Examiner* — Michael G Hoang
(74) *Attorney, Agent, or Firm* — Novick, Kim & Lee, PLLC; Jae Youn Kim

(57) ABSTRACT

A capsule-type heater device is provided. According to the present invention, a heating means is made from silicon carbide such that the durability thereof can be improved compared with a heating means made from metals, and a heating means is arranged inside a pair of ceramic cases so as to improve heat exchange efficiency of a thermal medium including air, which passes through the ceramic cases, thereby maximizing energy efficiency.

14 Claims, 8 Drawing Sheets

(51) Int. Cl.

| | |
|---|---|
| ***H05B 3/06*** | (2006.01) |
| ***H05B 3/10*** | (2006.01) |
| ***F24D 19/02*** | (2006.01) |
| ***F24H 9/00*** | (2006.01) |
| ***A45D 20/12*** | (2006.01) |
| ***A45D 1/04*** | (2006.01) |
| ***A45D 20/10*** | (2006.01) |
| ***H05B 3/16*** | (2006.01) |
| *A45D 1/00* | (2006.01) |

(56) References Cited

FOREIGN PATENT DOCUMENTS

| | | | |
|---|---|---|---|
| KR | 10-2013-0025752 | A | 3/2013 |
| KR | 10-1389878 | B1 | 4/2014 |
| KR | 10-2014-0104526 | A | 8/2014 |

* cited by examiner

CAPSULE-TYPE HEATER DEVICE

TECHNICAL FIELD

The present invention relates to a capsule-type heater device and, more particularly, to a capsule-type heater device which has a heater using silicon carbide and ceramic cases emitting anions and far infrared light and is configured such that the cases surround the heater so as to increase heat exchange efficiency with a thermal medium including air and thus to maximize energy efficiency.

BACKGROUND ART

In general, a heater device converts supplied electrical energy into thermal energy and heats a thermal medium including air using thermal energy.

For example, the heater device is mainly used in a hair dryer, an instantaneous water heater, a boiler, a dryer, a hot air blower, etc.

Most heater devices are configured such that a heating wire is manufactured as a coil and such a coil-type heating wire is disposed at the outside or inside of a specific case and contacts air so as to execute heat exchange.

Conventional technology using such a coil-type heating wire is described in a hair dryer disclosed in Korean Patent Registration No. 10-1389878 (Publication Date: Apr. 29, 2014). Among the accompanying drawings, as exemplarily shown in FIG. 1, the conventional hair dryer has a structure in which a coil-type heating wire serving as a heating means is wound on a wing.

When an air blower fan is operated under the condition that such a coil-type heating means is wound on the wing formed of an insulating member and power is supplied, air contacts the heating means and moves and, thus, heat exchange is carried out and hot air may be generated.

However, the hair dryer having such a structure has problems, as below.

First, a large number of elements are required to generate hot air and an assembly structure is complicated, and thus manufacturing costs are increased and workability and maintainability are lowered.

Second, the coil-type heating wire is used to generate hot air and thus consumption of electrical energy is increased.

Third, the coil-type heating wire used as the heating means is easily cut and is formed of metals, thus lowering heat efficiency and heat exchange efficiency.

PRIOR ART DOCUMENT

Patent Document (Patent Document 0001) Korean Patent Registration No. 10-1389878 (Publication Date: Apr. 29, 2014)

DISCLOSURE

Technical Problem

Therefore, the present invention has been made in view of the above problems, and it is an object of the present invention to provide an integral high-efficiency capsule-type heater device which has high heat efficiency and heat exchange efficiency and a far infrared light and anion emission function and is applicable to an instantaneous water heater, a boiler, a dryer, a hot air blower, a hair dryer, a warm air circulator, etc.

Additional advantages, objects, and features of the invention will be set forth in part in the description which follows and in part will become apparent to those having ordinary skill in the art upon examination of the following or may be learned from practice of the invention.

Technical Solution

In accordance with an aspect of the present invention, the above and other objects can be accomplished by the provision of a capsule-type heater device including a first case including a first body having a hollow shape and thus provided with a first heat exchange space formed therein so as to pass a thermal medium including air therethrough, and a first coupling part provided at the center of the inside of the first body and integrated with the inner circumferential surface of the first body by a plurality of first connection parts, first heater mounting grooves being respectively formed in the first connection parts, a second case including a second body having a hollow shape and thus provided with a second heat exchange space formed therein so as to pass the thermal medium including air therethrough, and a second coupling part provided at the center of the inside of the second body and integrated with the inner circumferential surface of the second body by a plurality of second connection parts, second heater mounting grooves being respectively formed in the second connection parts, the second case having a symmetrical structure with the first case, and a heater including a heating part molded to have the same shape as the first and second cases and mounted in the first and second heater mounting grooves, and power connection ends provided at both ends of the heating part, the heater being installed within the first and second cases coupled so that the first and second cases are opposite each other under the condition that the heating part is mounted in the first and second heater mounting grooves, wherein, as the thermal medium including air passes through the first and second heat exchange spaces under the condition that the heater is installed between the first and second cases, the thermal medium contacts the heater and the cases heated by the heater and thus executes heat exchange.

The first and second cases may be formed of ceramic so as to generate anions and far infrared light, and the first and second cases may be formed by mixing 1-3 parts by weight of natural phosphate minerals including phosphate (P) and a trace of silicon (Si), aluminum (Al), calcium (Ca), iron (Fe), yttrium (Y), zirconium (Zr), lanthanum (La), cesium (Ce), neodymium (Nd) or thorium (Th), with 100 parts by weight of an alumina ceramic material, including 94.5% by weight or more of $Al_2O_3$ and a mixture of $SiO_2$ and $CaO_2$, molding an acquired mixture using a mold, and sintering a molded product in a furnace at a temperature of 1,500° C. to 1,700° C.

The heater installed in the first and second cases may be molded by sintering a material including silicon carbide having purity of 99% or more at a high temperature.

The first and second cases may be formed of an alumina ceramic material including 94.5% by weight or more of $Al_2O_3$.

The first and second cases may be coupled by a bolt and a nut, passing through the first and second coupling parts, under the condition that the first and second heater mounting grooves are opposite each other.

Avoidance grooves to expose the power connection ends provided at both ends of the heater to the outside of the first and second bodies under the condition that the heater is mounted in the first and second heater mounting grooves may be formed at one side of each of the first and second bodies so as to be opposite each other.

The first and second cases may have a circular shape or a polygonal shape including a rectangular shape.

Advantageous Effects

In accordance with the present invention, a heating means is formed of silicon carbide such that durability thereof can be improved compared with a heating means formed of metals, and the heating means is arranged inside a pair of ceramic cases so as to improve heat exchange efficiency of a thermal medium including air, which passes through the ceramic cases, thereby maximizing energy efficiency.

Further, a capsule-type heater device in accordance with the present invention is applied to a hair dryer, a hot air blower, a warm air circulator, a boiler, an instantaneous water heater, etc. and may thus increase heat efficiency and reduce energy.

Moreover, the ceramic cases may emit far infrared light and anions.

BEST MODE

Hereinafter, embodiments of the present invention will be described with reference to the accompanying drawings. In the following description of the present invention, a detailed description of known functions and configurations incorporated herein will be omitted when it may make the subject matter of the present invention rather unclear.

Figure 1:
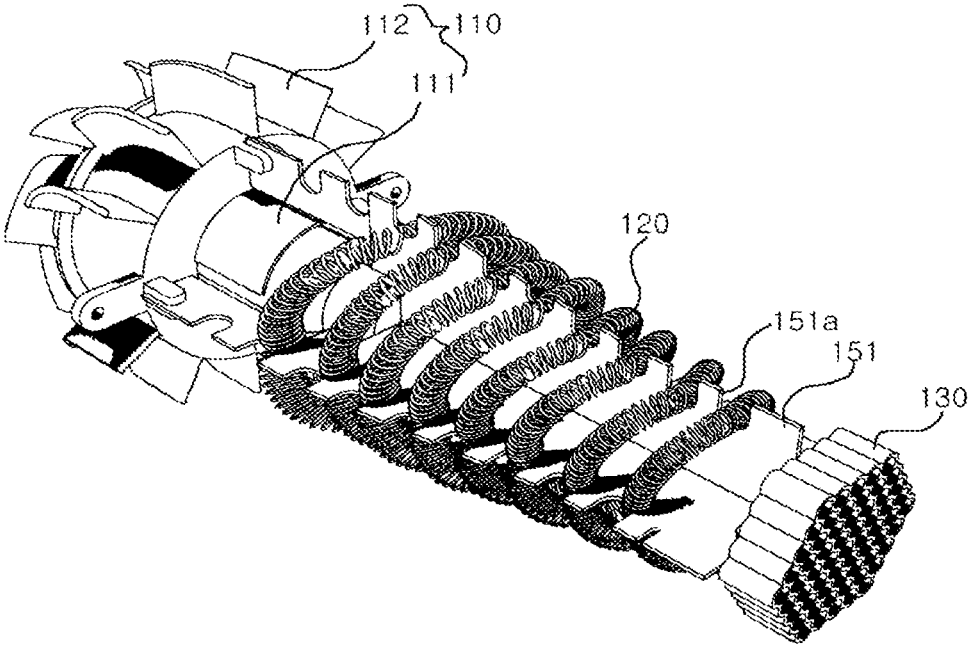
FIG. 1 is a perspective view of a conventional hair dryer.
Figure 2:
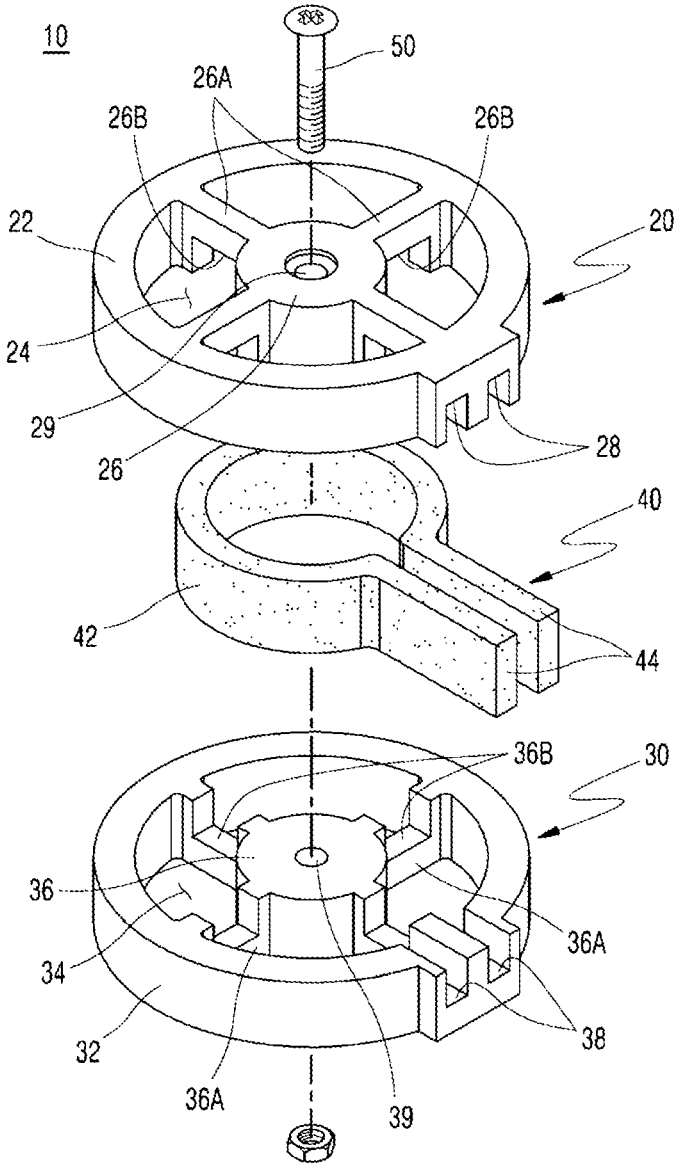
FIG. 2 is an exploded perspective view of a capsule-type heater device in accordance with one embodiment of the present invention.
Figure 3:
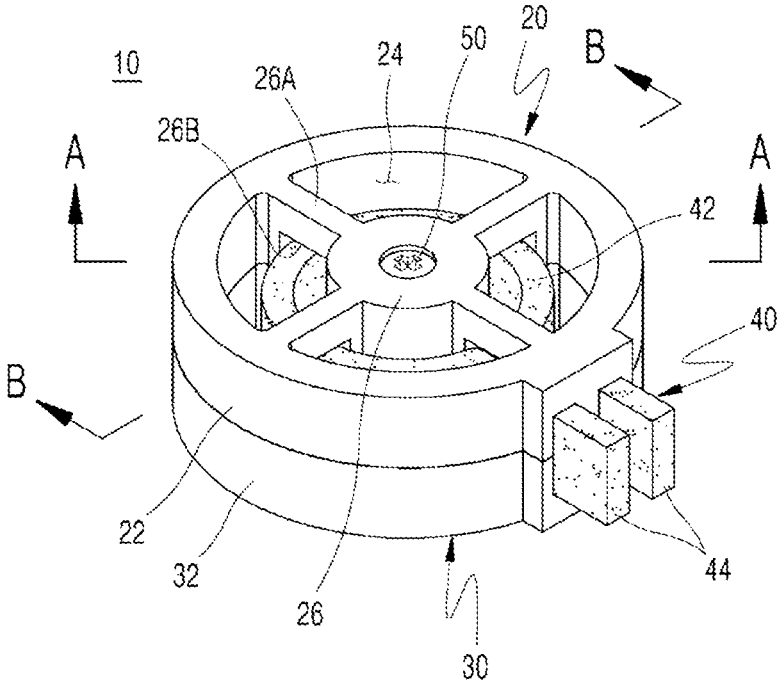
FIG. 3 is a perspective view illustrating the capsule-type heater device shown in FIG. 2 in an assembled state.
Figure 4A:
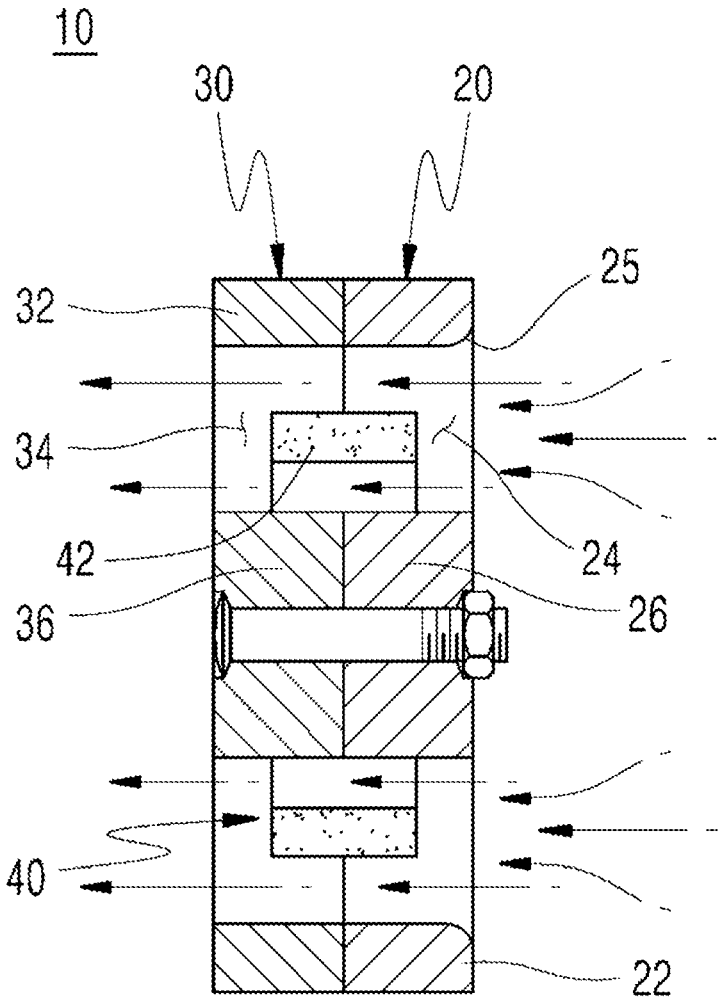
FIGS. 4A and 4B are cross-sectional views taken along lines A-A and B-B of FIG. 3.
Figure 4B:
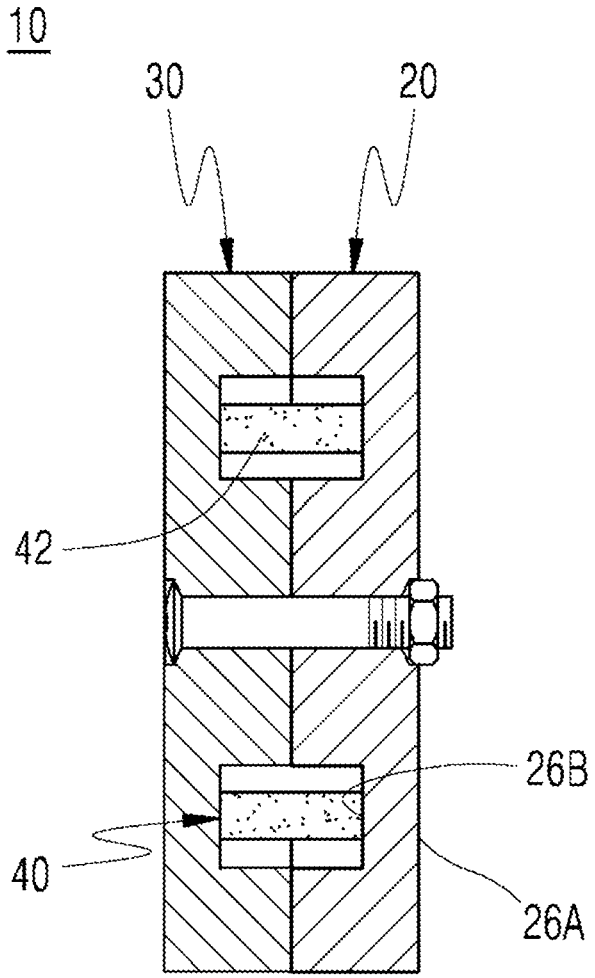

Among the accompanying drawings, FIG. 2 is an exploded perspective view of a capsule-type heater device in accordance with one embodiment of the present invention, FIG. 3 is a perspective view illustrating the capsule-type heater device shown in FIG. 2 in an assembled state, and FIGS. 4A and 4B illustrates cross-sectional views taken along lines A-A and B-B of FIG. 3.

As exemplarily shown in FIG. 2 and FIGS. 4A and 4B, a capsule-type heater device 10 in accordance with the present invention includes a heater 40 mainly formed of silicon carbide and a pair of first and second cases 20 and 30 formed of ceramic, and a thermal medium including air passes through the insides of the first and second cases 20 and 30, under the condition that power is applied to the heater, and contacts the heater 40 and the first and second cases 20 and 30 so as to execute heat exchange.

Now, the capsule-type heater device 10 will be described in more detail.

The capsule-type heater device 10 includes the first case 20 and the second case 30, which are symmetrical to each other, and the heater 40 installed between the first and second cases 20 and 30.

The first case 20 includes a first body 22 having a hollow shape and provided with a first heat exchange space 24 formed therein so as to pass a thermal medium including air therethrough, and a first coupling part 26 provided at the center of the inside of the first body 22 and connected to the first body 22 by a plurality of first connection parts 26A. Here, first heater mounting grooves 26B are respectively formed in the first connection parts 26A.

The first body 22 of the first case 20 is formed to have a cylindrical shape, and the first heat exchange space 24 formed in the first body 22 is divided by four first connection parts 26A.

The heater 40 is mounted in the first heater mounting grooves 26B so as not to interfere with coupling between the first and second cases 20 and 30 when the first and second cases 20 and 30 are coupled opposite each other.

Two avoidance grooves 28, which expose power connection ends 44 provided at both ends of the heater 40 to the outside of the first body 22 under the condition that the heater 40 is mounted in the first heater mounting grooves 26B, are formed at one side of the first body 22.

The second case 30 has a structure symmetrical with the first case 20, and includes a second body 32 having a hollow shape and provided with a second heat exchange space 34 formed therein so as to pass the thermal medium including air therethrough, and a second coupling part 36 provided at the center of the inside of the second body 32 and connected to the second body 32 by a plurality of second connection parts 36A. Here, second heater mounting grooves 36B are respectively formed in the second connection parts 36A.

The second body 32 of the second case 30 is formed to have a cylindrical shape, and the second heat exchange space 34 formed in the second body 32 is divided by four second connection parts 36A.

The heater 40 is mounted in the second heater mounting grooves 36B so as not to interfere with coupling between the first and second cases 20 and 30 when the first and second cases 20 and 30 are coupled opposite each other.

Further, two avoidance grooves 38, which expose the power connection ends 44 provided at both ends of the heater 40 to the outside of the second body 32 under the condition that the heater 40 is mounted in the second heater mounting grooves 36B, are formed at positions of one side of the second body 32 corresponding to the two avoidance grooves 28 formed on the first body 22 so as to have a shape symmetrical with the avoidance grooves 28 of the first body 22.

The first and second cases 20 and 30 are coupled opposite each other under the condition that a heating part 42 of the heater 40 is accommodated between the first and second mounting grooves 26B and 36B, and such coupling is carried out by a bolt 50 and a nut. That is, through holes 29 and 39, through which a screw part of the bolt 50 passes, are formed through the first and second coupling parts 26 and 36, and the first and second cases 20 and 30 in a pair are coupled by fastening the nut to the screw part of the bolt 50 passing through the through holes 29 and 39.

The first and second cases 20 and 30 are formed of ceramic so as to emit anions and far infrared light, and are manufactured by mixing 1-3 parts by weight of natural phosphate minerals including phosphate (P) and a trace of silicon (Si), aluminum (Al), calcium (Ca), iron (Fe), yttrium (Y), zirconium (Zr), lanthanum (La), cesium (Ce), neodymium (Nd) or thorium (Th), with 100 parts by weight of an alumina ceramic material, including 94.5% by weight or more of $Al_2O_3$ and a mixture of $SiO_2$ and $CaO_2$, molding an acquired mixture using a mold, and sintering a molded product in a furnace at a temperature of 1,500° C. to 1,700° C.

The natural phosphate minerals include phosphate (P) and a trace of silicon (Si), aluminum (Al), calcium (Ca), iron (Fe), yttrium (Y), zirconium (Zr), lanthanum (La), cesium (Ce), neodymium (Nd) or thorium (Th).

Such natural phosphate minerals are provided as powder having nanometer-scale particles so as to be easily mixed.

If less than 1 part by weight of the natural phosphate minerals is added to 100 parts by weight of ceramic, required properties are lowered and, if more than 3 parts by weight of the natural phosphate minerals are added to 100 parts by weight of ceramic, manufacturing costs are increased, as compared to expected properties. Therefore, 1-3 parts by weight of the natural phosphate minerals are preferably added to 100 parts by weight of ceramic.

The heater 40 includes the heating part 42 molded to have the same circular shape as the first and second cases 20 and 30 and mounted in the first and second heater mounting grooves 26B and 36B, and the power connection ends 44 provided at both ends of the heating part 42. The heating part 42 of the heater 40 is formed to have the same shape as the first and second cases 20 and 30. That is, the first and second cases 20 and 30 have a circular shape and, thus, the heating part 42 is molded to have a circular shape. Thereby, the heating part 42 is mounted in the first and second mounting grooves 26B and 36B without interference.

Such a heater 40 is molded by sintering a material including silicon carbide having purity of 99% or more at a high temperature.

The reason why the heater 40 is molded using silicon carbide is that silicon carbide has higher electrical resistance than graphite and, thus, the heating value of silicon carbide is greater than the heating value of graphite even when current of the same intensity is applied, and silicon carbide has excellent high temperature strength, oxidation resistance, corrosion resistance, etc.

Now, one example of manufacture of the heater 40 using such silicon carbide powder will be described. That is, slurry-phase mixed powder may be acquired by dispersing silicon carbide powder in a solvent, a green body may be acquired by inputting the mixed powder to a mold and then drying the mixed powder, and a sintered silicon carbide body may be acquired by primarily heating the green body to a temperature of 550° C. to 650° C. in a vacuum atmosphere, then heating the green body to a temperature of 1,500° C. or more in a nitrogen gas atmosphere, and maintaining the green body under the temperature condition in a nitrogen gas atmosphere. Of course, silicon carbide powder may be molded in a mold and then heated to a high temperature of 1,500° C. or more in a furnace so as to be sintered in a desired shape.

Any one selected from the first case 20 and the second case 30 may be provided with an inflow guide unit which facilitates inflow of a thermal medium including introduced air. This embodiment describes such an inflow guide unit as being formed on the first case 20. That is, a curved part 25 for inflow guidance is formed by chamfering or cutting the edge of an inlet of the first body 22 corresponding to an inlet of the first heat exchange space 24. As such, by forming the curved part 25 for inflow guidance at the inlet of the first heat exchange space 24, inflow of air or a thermal medium into the first heat exchange space 24 may be smoothly carried out without resistance.

Hereinafter, an assembly process of the above-described capsule-type heater device 10 will be described.

First, the heating part 42 of the heater 40 is inserted into and mounted in the second heater mounting grooves 26B formed in the second connection parts 36A of the second case 30, and the power connection ends 44 are inserted into the avoidance grooves 38 formed on the second body 32.

Here, the depth of the second heater mounting grooves 36B is greater than or equal to ½ the height (thickness) of the heating part 42. The reason for this is to prevent the heating part 42 from moving within the first and second heater mounting grooves 26B and 36B or to achieve close coupling between the first and second cases 20 and 30, when the first case 20 is coupled with the second case 30.

When the heater 40 is inserted into and mounted in the second heater mounting grooves 26B and the avoidance grooves 38, the first case 20 is coupled with the second case 30 such that the first heater mounting grooves 26B are opposite the second heater mounting grooves 36B and the avoidance grooves 28 of the first body 22 are opposite the avoidance grooves 38 of the second body 32.

Through such a process, the first and second coupling parts 26 and 36 may be opposite each other, the through holes 29 and 39 may coincide with each other so that the screw part of the bolt 50 passes through the through holes 29 and 39, and by fastening the nut to the screw part, the first and second cases 20 and 30 may be coupled with each other while surrounding both sides of the heater 40.

Since the first and second bodies 22 and 32 are coupled by the bolt 50 in the state in which the heater 40 is mounted in the first and second heater mounting grooves 26B and 36B of the first and second bodies 22 and 32, the heater 40 is surrounded with a pair of first and second cases 20 and 30 and, thus, the capsule-type heater device 10 is formed, as exemplarily shown in FIG. 3.

Therefore, the capsule-type heater device 10 is easily applicable to various apparatuses.

Figure 5:
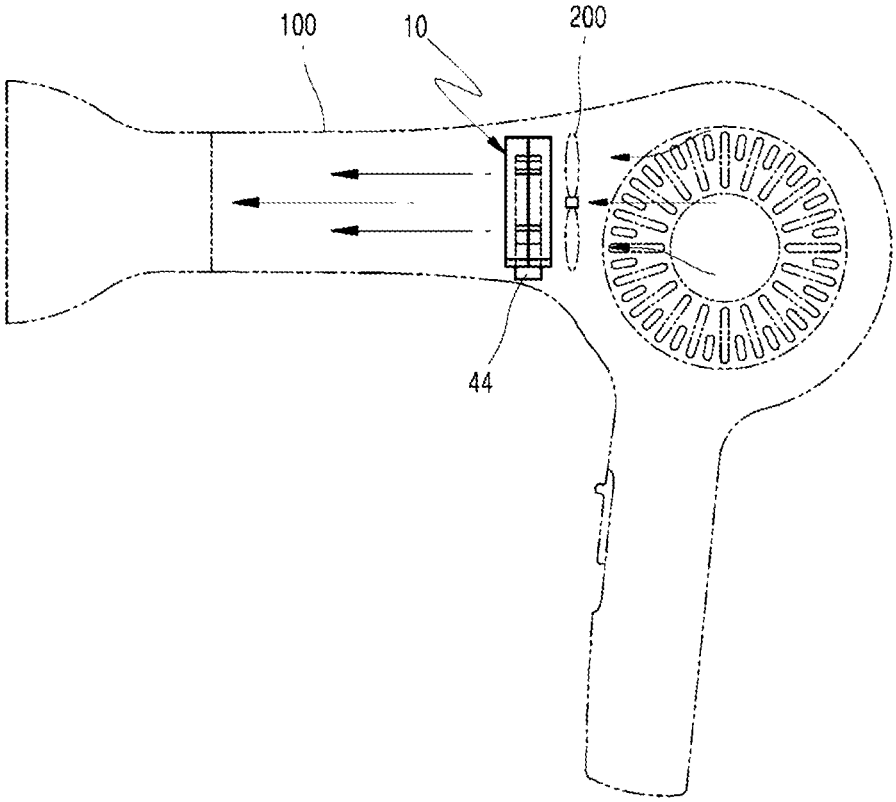
FIG. 5 is a schematic cross-sectional view illustrating the used state of the capsule-type heater device shown in FIG. 2.

For example, as exemplarily shown in FIG. 5, if the capsule-type heater device 10 in accordance with the present invention is applied to a warm air circulator to generate warm air, a dryer or a hair dryer, the capsule-type heater device 10 is installed within a housing 100, the heater 40 generates heat by applying power through the power connection ends 44 and thus the first and second cases 20 and 30 are heated, and, when a fan 200 to forcibly move air is operated in such a state, air is introduced into the first heat exchange space 24 formed within the first body 22 and is discharged through the second heat exchange space 34 formed within the second body 32. That is, air passes through the first and second heat exchange spaces 24 and 34.

Here, air introduced into the first heat exchange space 24 may be effectively introduced into the first heat exchange space 24 without resistance at the inlet of the first heat exchange space 24 by the curved part 25 for inflow guidance.

When air passes through the first and second heat exchange spaces 24 and 34 by such operation of the fan 200, air contacts the heating part 42 of the heater 40 and then contacts the first and second connection parts 26A and 36A heated by the heating part 42, the first and second coupling parts 26 and 36 and the first and second bodies 22 and 32 so as to achieve heat exchange and, thereby, air having passed through the first and second cases 20 and 30 is in a raised temperature state.

Since air passes through only the first and second heat exchange spaces 24 and 34 in such a manner, heat exchange between air and not only the heater 40 but also inner structures of the first and second cases 20 and 30 heated by the heater 40 (i.e., the bodies, the coupling parts, the connection parts, etc.) is carried out and, thus heat exchange efficiency is increased.

That is, as air passes through only the insides of the first and second cases 20 and 30, air contacts the heater 40 and the first and second cases 20 and 30 to execute heat exchange and, thus, heat exchange (heat discharge) may be executed without heat loss.

Further, since the first and second cases 20 and 30 formed of ceramic are heated by the heating part 42, far infrared light and anions are generated, as confirmed through a test example described below, air having a raised temperature by passing through the first and second cases 20 and 30 contains anions as well as far infrared light good for human health. Of course, far infrared light is not emitted along air but far infrared light may be radiated to positions close to the first and second cases 20 and 30.

Figure 6:
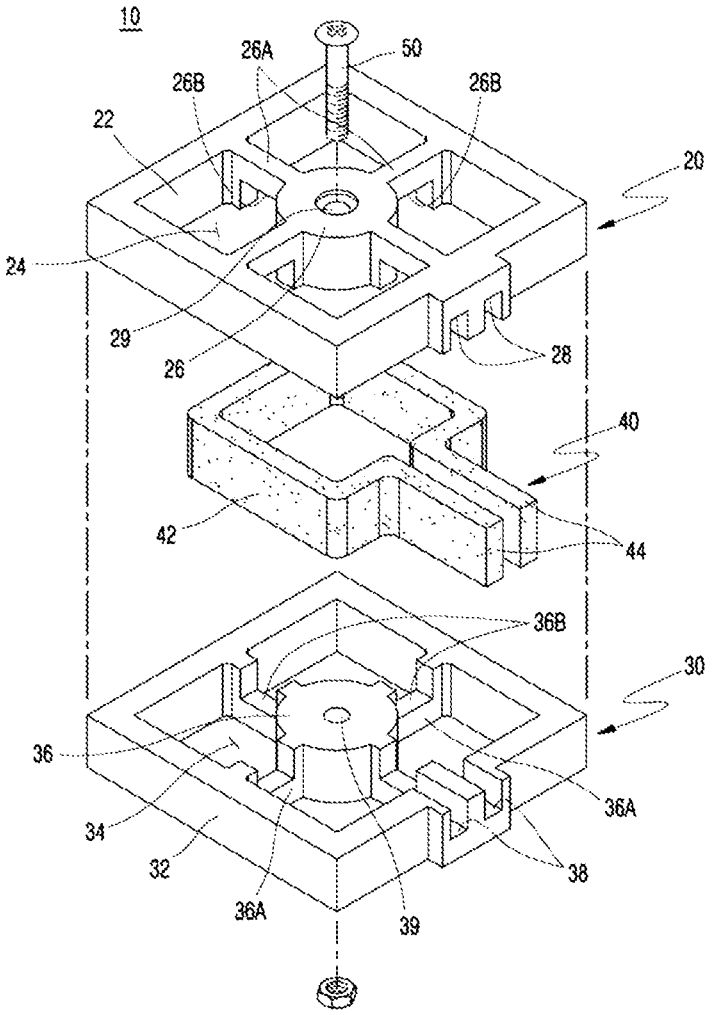
FIG. 6 is an exploded perspective view illustrating the capsule-type heater device shown in FIG. 2 in accordance with another embodiment of the present invention.
Figure 7:
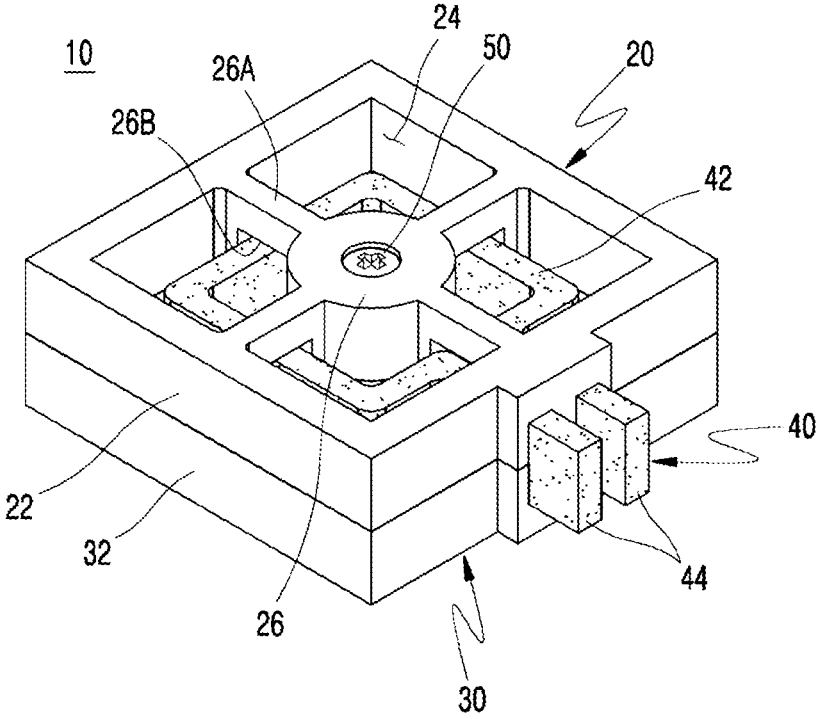
FIG. 7 is a perspective view of the capsule-type heater device shown in FIG. 6 in an assembled state.

Among the accompanying drawings, FIGS. 6 and 7 illustrate a capsule-type heater device 10 in accordance with another embodiment of the present invention.

That is, this embodiment is the same as the former embodiment except that first and second cases 20 and 30 and a heater 40 have a polygonal shape, more particularly a rectangular shape.

The reason why the first and second cases 20 and 30 and the heater 40 have a rectangular shape is to properly apply the capsule-type heater device 10 to various apparatuses (an instantaneous water heater, a water cooler-heater, a dryer, a microwave oven, a hair dryer, a warm air circulator, etc.).

As described above, since the heater 40 is surrounded by a pair of hollow-type first and second cases 20 and 30, air passing through the first and second cases 20 and 30 contacts only the heater 40 and the first and second cases 20 and 30 and exchanges heat and, thus, heat exchange efficiency may be increased, the first and second cases 20 and 30 are formed of a ceramic material and may thus emit far infrared light and anions, and the heater device 10 is encapsulated and may thus be easily applied to various products.

[Manufacturing Example of Cases]

In order to manufacture cases, 20 g of natural phosphate minerals are mixed with 1,000 g of an alumina ceramic material including 950 g of $Al_2O_3$, 20 g of $SiO_2$ and 30 g of $CaO_2$, an acquired mixture is molded using a mold, and a molded product is sintered in a furnace at a temperature of 1,600° C., thereby manufacturing alumina ceramic cases.

Table 1 below states physical and mechanical properties of the cases manufactured by the above manufacturing example.

TABLE 1

| Physical and mechanical properties | Process and inspection precision | |
|---|---|---|
| Division | Unit | 95% alumina |
| Porosity | % | 0 |
| Density | gm/cm | >3.65 |
| Hardness | HRA | 82 |
| Flexural strength | MPa | ≥270 |
| Compressive strength | MPa | 1330 |
| Tensile strength 25° C. | MPa | 105 |
| Linear coefficient of thermal expansion | mm/° C. 25° C.-300° C. | $<6.2 \times 10^{-6}$ |
| Dielectric constant at 25→C | 1 MH 20° C. | ≤9 |
| Dielectric strength | KV/mm | ≥20 |

TABLE 1-continued

| Physical and mechanical properties | Process and inspection precision | |
|---|---|---|
| Division | Unit | 95% alumina |
| Thermal conductivity at 25→C | W/m · K | 18 |
| Safe use temperature | ° C. | 1450 |
| Volume resistance | $\Omega cm^2/cm$(25° C.) | $\geq 10^{14}$ |
| Water absorption | % | 0 |

Test Example

Anions emitted from a capsule-type heater device having the cases manufactured by the above-described manufacturing example of the present invention were measured using an anion (far infrared light emission rate) measuring instrument.

Measurement Instrument: COM-31010PRO (manufactured by COM SYSTEM. INC, Japan)

Measurement Method: Contact type

Unit: $cm^3/cc$

Error range 50-90 $cm^3/cc$

TABLE 2

| Anion emission amount | | |
|---|---|---|
| Number of measurements | Product according to invention | Comparative product |
| First | 1874 $cm^3/cc$ | 380 $cm^3/cc$ |
| Second | 1802 $cm^3/cc$ | 483 $cm^3/cc$ |
| Third | 1868 $cm^3/cc$ | 409 $cm^3/cc$ |

TABLE 3

| Mean anion emission amount | |
|---|---|
| Product | Mean anion (far infrared light) emission amount |
| Product according to invention | 1848 $cm^3/cc$ |
| Comparative product | 424 $cm^3/cc$ |

*Comparative product

.Manufacturer: Mears Co., Ltd., China

.Product Name: Celeston

It may be understood that the product having the cases manufactured in accordance with the embodiment of the present invention emits a greater amount of anions than comparative products manufactured by other companies, as described in the above test example.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Thus, it is intended that the present invention covers the modifications and variations of this invention provided they come within the scope of the appended claims and their equivalents.

DESCRIPTION OF REFERENCE NUMERALS AND MARKS

10: Capsule-type heater device 20: first case
22: first body 24: first heat exchange space
25: curved part for inflow guidance

26: first coupling part 26A: first connection part
26B: first heater mounting groove 28, 38: avoidance groove
29, 39: through hole 30: second case
32: second body 34: second heat exchange space
36B: second heater mounting groove
40: heater 42: heating part
44: power connection end 50: bolt

The invention claimed is:

1. A capsule-type heater device comprising:

a first case including a first body having a hollow shape and thus provided with a first heat exchange space formed therein so as to pass a thermal medium including air therethrough, and a first coupling part provided at a center of an inside of the first body and integrated with an inner circumferential surface of the first body by a plurality of first connection parts, first heater mounting grooves being respectively formed in the first connection parts;

a second case including a second body having a hollow shape and thus provided with a second heat exchange space formed therein so as to pass the thermal medium including air therethrough, and a second coupling part provided at a center of an inside of the second body and integrated with an inner circumferential surface of the second body by a plurality of second connection parts, second heater mounting grooves being respectively formed in the second connection parts, the second case having a symmetrical structure with the first case; and a heater including a heating part molded to have the same shape as the first and second cases and mounted in the first and second heater mounting grooves, and power connection ends provided at both ends of the heating part, the heater being installed within the first and second cases coupled so that the first and second cases are opposite each other in a configuration that the heating part is mounted in the first and second heater mounting grooves, wherein, as the thermal medium including air passes through the first and second heat exchange spaces in a configuration that the heater is installed between the first and second cases, the thermal medium contacts the heater and the cases heated by the heater and thus executes heat exchange.

2. The capsule-type heater device according to claim 1, wherein the first and second cases are formed of ceramic so as to generate anions and far infrared light, and wherein the first and second cases are formed by mixing 1-3 parts by weight of natural phosphate minerals including phosphate (P) and a trace of silicon (Si), aluminum (Al), calcium (Ca), iron (Fe), yttrium (Y), zirconium (Zr), lanthanum (La), cesium (Ce), neodymium (Nd) or thorium (Th), with 100 parts by weight of an alumina ceramic material, including 94.5% by weight or more of $Al_2O_3$ and a mixture of $SiO_2$ and $CaO_2$, molding an acquired mixture using a mold, and sintering a molded product in a furnace at a temperature of 1,500° C. to 1,700° C.

3. The capsule-type heater device according to claim 1, wherein the heater installed in the first and second cases is molded by sintering a material including silicon carbide having purity of 99% or more.

4. The capsule-type heater device according to claim 1, wherein the first and second cases are formed of an alumina ceramic material including 94.5% by weight or more of $Al_2O_3$.

5. The capsule-type heater device according to claim 1, wherein the first and second cases are coupled by a bolt and a nut, passing through the first and second coupling parts, in a configuration that the first and second heater mounting grooves are opposite each other.

6. The capsule-type heater device according to claim 1, wherein avoidance grooves to expose the power connection ends provided at the both ends of the heating part to an outside of the first and second bodies, in the configuration that the heating part is mounted in the first and second heater mounting grooves are formed at one side of each of the first and second bodies so as to be opposite each other.

7. The capsule-type heater device according to claim 1, wherein a curved part for inflow guidance is formed by chamfering or cutting an edge of an inlet of the first heat exchange space of the first case or an edge of an inlet of the second heat exchange space of the second case so as to allow inflow of the thermal medium including air without resistance.

8. The capsule-type heater device according to claim 1, wherein the first and second cases have a circular shape or a polygonal shape including a rectangular shape.

9. The capsule-type heater device according to claim 2, wherein the first and second cases have a circular shape or a polygonal shape including a rectangular shape.

10. The capsule-type heater device according to claim 3, wherein the first and second cases have a circular shape or a polygonal shape including a rectangular shape.

11. The capsule-type heater device according to claim 4, wherein the first and second cases have a circular shape or a polygonal shape including a rectangular shape.

12. The capsule-type heater device according to claim 5, wherein the first and second cases have a circular shape or a polygonal shape including a rectangular shape.

13. The capsule-type heater device according to claim 6, wherein the first and second cases have a circular shape or a polygonal shape including a rectangular shape.

14. The capsule-type heater device according to claim 7, wherein the first and second cases have a circular shape or a polygonal shape including a rectangular shape.

* * * * *